United States Patent [19]

Mochida

[11] 4,437,137

[45] Mar. 13, 1984

[54] ELECTRONIC DOOR LOCKING SYSTEM FOR AN AUTOMOTIVE VEHICLE

[75] Inventor: Haruo Mochida, Kiyokawa, Japan

[73] Assignee: Nissan Motor Company, Limited, Kanagawa, Japan

[21] Appl. No.: 432,383

[22] Filed: Sep. 30, 1982

[30] Foreign Application Priority Data

Jan. 14, 1982 [JP] Japan ..... 57-3323

[51] Int. Cl.[3] ..... H01H 47/00

[52] U.S. Cl. ..... 361/172; 307/10 AT

[58] Field of Search ..... 361/193, 172, 171; 180/287, 289; 307/10 R, 10 AT; 70/277, 278

[56] References Cited

U.S. PATENT DOCUMENTS 3,691,396 9/1972 Hinrichs ..... 361/172 X 3,831,065 8/1974 Martin et al. ..... 361/172

4,232,354 11/1980 Mueller et al. ..... 361/172

4,240,516 12/1980 Henderson et al. ..... 307/10 AT X

*Primary Examiner*—Reinhard J. Eisenzopf

*Attorney, Agent, or Firm*—Lowe, King, Price & Becker

[57] ABSTRACT

An automotive vehicle electronic door locking system returns vehicle devices left in operation to an original disabled condition whenever the driver locks the vehicle doors by depressing at least one of a plurality of coded push-button type switches installed at an appropriate position on the outside of an automotive vehicle. Since the vehicle devices, such as a power-operated car-radio antenna, small lights, a room light, etc., are automatically returned to an original disabled condition, it is possible to park the vehicle safely after the vehicle doors have been locked. The vehicle devices are actuated to the original disabled condition thereof in response to a lock command signal, in addition to the conventional electronic door locking system.

5 Claims, 1 Drawing Figure

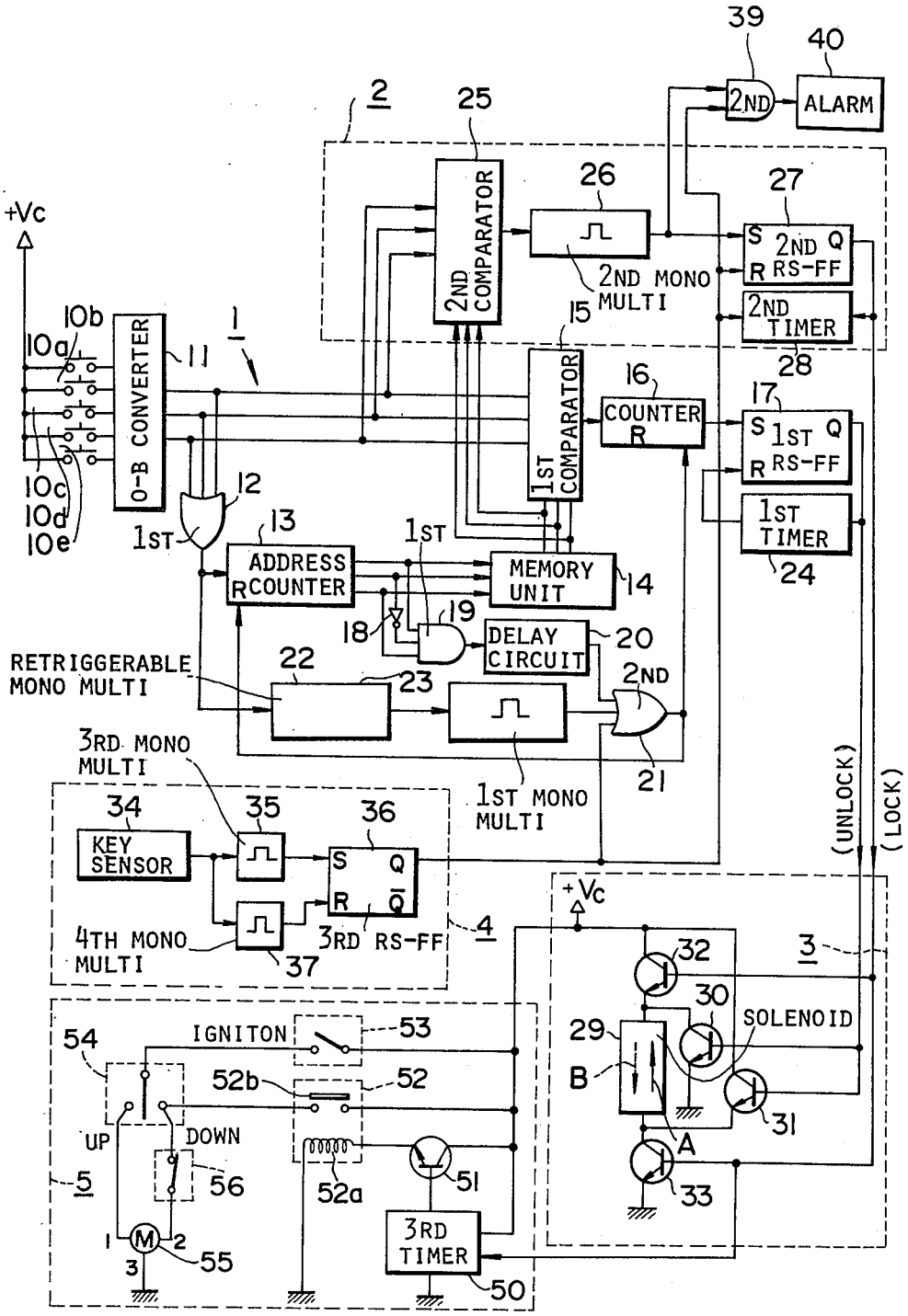
+Vc
10a
10b
10c
10d
10e
0-B CONVERTER
11
1
12
1ST
13
ADDRESS COUNTER
R
1ST
MEMORY UNIT
14
18
19
DELAY CIRCUIT
20
RETRIGGERABLE MONO MULTI
22
23
2ND
21
1ST MONO MULTI
3RD MONO MULTI
34
KEY SENSOR
35
36
S
Q
R
Q̄
3RD RS-FF
4TH MONO MULTI
37
4
2
25
2ND COMPARATOR
26
2ND MONO MULTI
15
1ST COMPARATOR
16
COUNTER
R
27
2ND RS-FF
2ND TIMER
28
17
1ST RS-FF
1ST TIMER
24
39
2ND
40
ALARM
(UNLOCK)
(LOCK)
+Vc
3
32
30
SOLENOID
29
B
31
A
33
54
IGNITON
53
52b
52
UP
DOWN
56
5
52a
51
1
M
2
3
55
3RD TIMER
50

ELECTRONIC DOOR LOCKING SYSTEM FOR AN AUTOMOTIVE VEHICLE

BACKGROUND OF THE INVENTION

1. Field of the Invention

The present invention relates generally to an electronic push-button type door locking device for an automotive vehicle, and more particularly to an electronic door locking system by which vehicle doors can be locked or unlocked when the driver depresses a plurality of push-button type switches in accordance with a predetermined code.

2. Description of the Prior Art

The background of the present invention is described with respect to its application with an automotive vehicle.

As is well-known, there exists an electronic push-button type door locking system for an automotive vehicle, by which vehicle doors can be locked or unlocked when the driver depresses a plurality of push-button type switches installed at an appropriate position on the outside of an automotive vehicle in accordance with a predetermined code. Use of such an electronic vehicle door locking system as described above to lock or unlock vehicle doors is very convenient for the driver, since the vehicle doors can be locked or unlocked by the driver without using the ignition key. Such systems are particularly useful when the vehicle is left parked.

In the above-mentioned electronic door locking system, however, there exists the danger that the driver after having locked the doors by using the electronic push-button type door locking system, might carelessly forget that some of the vehicle devices or lights remain in operation and leave his vehicle. In this case, since the ignition key has already been extracted from the ignition keyhole, many devices or apparatus may be inoperative or remain turned off. However, since certain devices or lights can be operated or turned on or unlocked or opened even when the ignition key is not in the keyhole, in the case where the driver notices that a device is still in operation or kept turned on or unlocked dangerously or unsafely after having locked the doors, he must first unlock the doors, get in the car and depress a switch or turn off the devices or apparatus within the passenger compartment, thus necessitating a troublesome procedure.

The devices or lights described above are, for instance, a power-operated car-radio antenna, small lights (or dimed headlights), a room light, a device for locking the trunk room or the console box, a device for closing the side door windows or the sunroof, etc.

SUMMARY OF THE INVENTION

With these problems in mind, therefore, it is the primary object of the present invention to provide an electronic door locking system for an automotive vehicle in which devices or lights left in operation or kept turned on or left unlocked or opened dangerously or unsafely within the passenger compartment can be tuned off or returned to an original disabled condition in response to a locking signal generated whenever the driver locks the vehicle doors by depressing a plurality of push-button type switches installed at an appropriate position on the outside of an automotive vehicle in accordance with a predetermined code.

Therefore, in the electronic automotive door locking system according to the present invention, even if the driver locks the vehicle doors and leaves the vehicle without disabling or turning off the vehicle devices, when the vehicle doors are locked by depressing the push-button switches in accordance with the predetermined code, the vehicle devices are automatically returned an original disabled condition and the vehicle can be parked safely.

To achieve the above-mentioned object, the electronic door locking system for an automotive vehicle according to the present invention comprises means for actuating vehicle devices to the original disabled conditions thereof in response to a lock command signal generated whenever the driver locks the vehicle doors and the door locking system for an automotive vehicle. The vehicle device actuating means comprises, for instance, a timer unit for actuating the vehicle device for a predetermined time period, a switching element, a relay, actuators, etc.

BRIEF DESCRIPTION OF THE DRAWINGS

The features and advantages of the electronic door locking system for an automotive vehicle according to the present invention will be more clearly appreciated from the following description of the preferred embodiment of the invention taken in conjunction with the accompanying drawing in which;

The FIGURE is a schematic block diagram of an embodiment of the electronic door locking system according to the present invention.

DETAILED DESCRIPTION OF THE PREFERRED EMBODIMENTS

First, the circuit configuration of an embodiment of the electronic door locking system according to the present invention will be described hereinbelow with reference to the attached drawing.

The system according to the present invention can roughly be divided into five sections: a door unlocking command signal generating section 1, a door locking command signal generating section 2, a door lock/unlock actuating section 3, and an ignition key sensor section 4, and a vehicle device actuating section 5 closely related to the present invention.

In the door unlocking command signal generating section 1, a plurality of push-button type switches 10*a*–10*e* are arranged at an appropriate position on the outer surface of a vehicle door. To unlock vehicle doors, a specific sequence of numerals, such as the five digits "2-1-3-5-4" are used; while to lock the vehicle doors, a single specific numeral, such as the digit "2" (the first of the above five digits) is used. An octal-binary code converter 11 (referred to as O-B converter 11 hereinafter) for converting the octal code designated by the push-button switches 10*a*–10*e* into the corresponding three-bit binary code. A first OR gate 12 generates an H-voltage level output signal whenever the O-B converter 11 derives a three-bit binary coded signal. Address counter 13 generates an address-designating signal which is advanced incrementally by the H-voltage level signals from the OR gate 12.

In other words, when a first signal is supplied to the address counter 13 via the first OR gate 12, the counter 13 derives a three-bit binary signal "001" to designate address No. 1 in a memory unit 14; when a second signal is supplied to the address counter 13 via the first OR gate 12, the counter 13 derives a three-bit binary signal "010" to designate address No. 2 in the memory unit, and so on.

Memory unit 14 is a RAM or ROM in which the above-mentioned numerical code "2-1-3-5-4" is previously stored in the form of binary coded digits. The respective binary coded digits corresponding to the above-mentioned octal code "2-1-3-5-4" are read out sequentially in response to the address-designation signals derived from the address counter 13. A first comparator is compared the binary coded digits derived from the O-B converter 11 with binary coded digits read out from the memory unit 14. Comparator 15 derives an H-voltage level signal whenever the digits agree. Counter 16 responds to comparator 15 to derive a signal when the comparator has consecutively supplied the comparator with a predetermined number of signals (five signals in this emmbodiment). A first reset-set flip-flop 17 (referred to as RS-FF hereinafter) generates a door unlocking command signal when set by the output signal from the counter 16.

A logic circuit formed by inverter 18, a first AND gate 19, delay 20, and a second OR gate 21. resets the counter 16 to a L-voltage level a fixed period of time after the predetermined octal unlocking code "2-1-3-5-4" has been supplied by the automobile driver to the O-B converter 11 via the push-button switches 10*a*–10*e*.

In more detail, since the three-bit address signals from the address counter 13 are applied to the respective input terminals of the first AND gate 19, when the last digit of the octal unlocking code is derived, the address counter 13 derives a three-bit binary signal "101" (5 in octal code) to designate address No. 5 in the memory unit 14. The binary signal 101 is recognized as address No. 5 because all three independent input terminals of first AND gate 19 are supplied with binary one levels. The first AND gate 19 derives a H-voltage level signal because "0" of the 2nd input terminal is applied to the first AND gate 19 after having been inverted into "1" through the inverter 18 and the other two inputs of the AND gate are binary ones. This H-voltage level output signal from the first AND gate 19 is supplied to the delay circuit 20, and, after a fixed period has elapsed, the output signal from the delay circuit 20 resets the counter 16 through the second OR gate 21.

Retriggerable monostable multivibrator 22 is retriggered when a H-voltage level signal is supplied thereto within a predetermined period of time. Monostable 22 is automatically reset to a L-voltage level when no H-voltage level signal is supplied thereto within a predetermined period of time. A first monostable multivibrator 23 is automatically reset to a L-voltage level after a H-voltage level is derived for a predetermined period of time after being triggered. Elements 22 and 23 reset the counter 16 to a L-voltage level when the push-button swithces are not depressed consecutively, that is, when the switches are depressed intermittently with delays exceeding a predetermined time interval. If the counter 16 is reset before deriving a signal, the first RS-FF 17 is not set and so will not derive a door unlocking signal. In more detail, the output signal from the first OR gate 12 is applied to the retriggerable monostable multivibrator 22 and the first monostable multivibrator 23 is so designed as to be triggered by the trailing edge of the output signal from the retriggerable monostable multivibrator 22. Therefore, in the case where the O-B converter 11 outputs binary coded consecutively enables the trigger terminal of the retriggerable monostable multivibrator 22, the multivibrator 22 is repeatedly triggered to a H-voltage level without dropping to the L-voltage level as long as the binary coded signsals are derived. Therefore, the first monstable multivibrator 23 is not triggered into a H-voltage level (because the first multivibrator 23 can be triggered only when the retriggerable multivibrator 22 changes to a L-voltage level), so that the counter 16 is not reset through the second OR gate 21. In the case where the O-B converter 11 supplies binary coded signals to the trigger terminal of the retriggerable monstable multivibrator 22 intermittently, with delays exceeding a predetermined time interval (determined by setting a time constant of the CR circuit in the multivibrator 22), the retriggerable monostable multivibrator 22 is automatically reset to a L-voltage level before the next binary coded signal from the first OR gate 12 triggers it. The trailing edge of the output signal from monostable 22 triggers the first monostable multivibrator 23 via the second OR gate 21 to reset counter 16 to the original condition brefore counter 16 can supply a H-level signal to the first RS-FF 17.

Furthermore, after being set, the first RS-FF 17 for deriving a door unlocking signal is reset after a predetermined period of time by an output signal from a first timer 24 which starts in response to the H-voltage level output signal from the first RS-FF 17.

In the door locking command signal generating section 2 are provided a second comparator 25, a second monostable multivibrator 26 and a second RS-FF27.

To lock the vehicle doors, for instance, the automobile driver depresses one of the push buttons 10*a*–10*e* associated with the first digit "2" of the five consecutive unlocking numerals "2-1-3-5-4".

When a push-button switch corresponding to "2" is depressed, the O-B converter 11 derives a corresponding first binary coded signal "010". When this first signal is supplied to the address counter 13 via the first OR gate 12, the counter 13 derives a three-bit binary signal "001" to designate address No. 1 in the memory unit 14. Therefore, a first stored coded signal is read out from the memory unit 14; this signal is compared with the output signal from the O-B converter 11 by the second comparator 25. When the signals supplied to comparator 25 agree, the the comparator triggers the second monostable multivibrator 26. As a result, the second RS-FF 27 is set by the output signal from the second monostable multivibrator 26, in order to generate a door locking signal. After being set, the second RS-FF 27 for deriving a door locking signal is reset after a predetermined period of time by an output signal from a second timer 28 which starts in response to the H-voltage level output signal from the second RS-FF 27.

In the door lock/unlock actuating section 3 are included a solenoid 29 and a switching circuit including transistors 30–33.

The solenoid 29 is used for locking or unlocking the vehicle doors according to the direction of current flowing therethrough. If the first RS-FF 17 derives door unlocking command signal, current is applied to the base of the first transistor 30, causing turn on of the first transistor 30. In addition, current is also applied to the base of the second transistor 31, causing turn on of the second transistor 31 so that a solenoid energizing current flows from the positive terminal +Vc through the second transistor 31, the solenoid 29, and the first transistor 30 to ground in the direction of arrow A, so that the solenoid 29 is energized to unlock the vehicle doors. If the second RS-FF 27 derives a door locking command signal, current is applied to the base of the fourth transistor 33, causing turn on of the fourth transistor 33. In addition, current is applied to the base of the third transistor 32, causing turn on of the third transistor 32 so that a solenoid energizing current flows from the positive terminal +Vc through the third transistor 32, the solenoid 29, and the fourth transistor 33 to ground in the direction of arrow B, so that the solenoid 29 is energized to lock the vehicle doors.

In the ignition key sensor section 4, a key sensor 34 derives a H-voltage level signal when the ignition key is left in the ignition keyhole. Sensor 4 also includes a third monostable multivibrator 35, a third RS-FF 36, and a fourth monostable multivibrator 37.

If the ignition key is inserted in the keyhole, the key sensor 34 derives a H-voltage level signal to trigger the third monostable multivibrator 35; therefore, the third RS-FF 36 is set to a H-voltage level output. Since the output terminal Q of this the third RS-FF 36 is connected to the reset terminal R of the second RS-FF 27, the RS-FF 27 is forcedly reset by the signal from the third RS-FF 36, so that the RS-FF 27 cannot derive a door locking command signal, even if an appropriate push-button switch is depressed to lock the door and the ignition key is left in the ignition keyhole.

The fourth monostable multivibrator 37 is triggered when the ignition key is extracted from the keyhole, that is, when the output signal from the key sensor 34 returns to a L-voltage level, so that the third RS-FF 36 is reset to prevent supplying a reset signal to the second RS-FF 27. Thus, the second RS-FF 27 now derives a door locking command signal if the appropriate push-button switch is depressed.

The device includes an alarm device 40, such as a buzzer or chime, driven by the output of a second AND gate. If a door lock signal is derived by activating the push-button switch 10 with the ignition key in the keyhole, alarm device 40 is activated to indicate to the driver that the ignition key is still in the keyhole and that the door lock is inoperative. This is because both the signals from the second monostable multivibrator 26 and from the third RS-FF 36 are applied to the second AND gate 39 which is enabled to activate the alarm.

As described above, the electronic door locking system for an automative vehicle according to the present invention basically comprises the above-mentioned four sections of the door unlocking command signal generating section 1, the door locking command signal generating section 2, the door lock/unlock actuating section 3, and the ignition key sensor section 4. In addition to these four sections, the system according to the present invention further comprises a vehicle device actuating section 5. The attached Figure includes a power-operated car-radio antenna actuating section, by way of example, for section S.

In the section 5, a third timer unit 50 outputs a H-voltage level signal for a predetermined time period in response to a locking command signal from the second RS-FF 27 provided in the door locking command signal generating section 2. A switching element 51 such as a transistor, is turned on for a fixed time period in response to the H-voltage level signal derived from the third timer unit 50. A relay 53 including a relay energizing coil **52*a* is connected to the emitter of the transistor 51. Relay 52 includes a normally-open contact 52*b* which is closed when the relay coil 52*a* is energized. Unit 50 includes an ignition switch 53 and an antenna 54 including an up-contact and a down-contact. The up-contact is directly connected to a first terminal of an actuator 55, such as an antenna driving motor, and the down-contact is indirectly connected to a second terminal of the actuator 55, such as the antenna driving motor, via a limit switch 56. Since a third terminal of the motor 55 is grounded, when a positive voltage +Vc is applied to the first motor terminal, the motor 55 rotates in a first direction to drive the antenna upwardly, that is, to extend the antenna outwardly; when the positive voltage +Vc is applied to the second terminal, the motor 55 rotates in a second direction to drive the antenna downwardly, that is, to telescope the antenna inwardly. Further, the limit switch 56 is open circuited to cut off the current supplied to the motor 55 when the antenna is completely telescoped. This limit switch 56 serves to prevent noise from being generated while a clutch (not shown) roates in an idle condition. It is possible to omit this limit switch 55 from the system where it is unnecessary. Further, the ignition switch 53 and the relay 52** are both connected to the power supply +Vc.

The operation of the electronic door locking system for an automotive vehicle according to the present invention is described infra.

In order to unlock the vehicle door, first a sequence of predetermined octal digits (2-1-3-5-4) is supplied by the automobile driver via the switches **10*a*–10*e*. The O-B converter derives a series of three-bit binary numbers (010-001-011-101-100) corresponding to the octal digits. Whenever the O-B converter derives a three-bit binary signal, the address counter 13 is advanced incrementally via the first OR gate 12 to derive an address designation signal ranging from No. 1 to No. 5, respectively; in response to these address-designation signals the memory unit 4 derives the three-bit binary codes previously stored in the designated memory addresses. These three-bit codes are compared with the digits derived by the first comparator 15 in response to the signal from the O-B converter. If the numbers match, the comparator 15 derives a H-level signal. After a series of binary unlocking numbers has been successfully compared, the counter 16 sets the first RS-FF 17**, which in turn derives a door unlocking signal.

Further, when the last unlocking number key is depressed by the operator the address-designation signal No. 5 (101) is derived from the address counter 13. Counter 16 is reset after a predetermined period of time determined by the delay circuit 20. If the unlocking keys are depressed intermittently with delays exceeding a predetermined time interval, the counter 16 is also reset through the retriggerable monostable multivibrator 22 and the first monostable multivibrator 23.

If the door is locked from outside the vehicle by depressing the appropriate push-button switch **10*a*–10*e* with the ignition key left inserted in the keyhole, the key sensor 34 derives a H-voltage level signal indicative of the presence of the key. Thereby the RS-FF 36 is set by a trigger signal from the monostable multivibrator 35. Therefore, the reset terminal R of the second RS-FF 27 goes to a H-voltage level, that is, to the reset state, compulsorily. As a result, even if the proper push-button switch 10*a*–10*e* is depressed to lock the door, no locking signal is derived, disabling door lock operation. At the same time, the H-voltage level output signal of the AND gate 39 actuates the alarm device 40**, indicating to the driver that the ignition key is still in the keyhole and that the doors can not be locked.

Therefore, the driver notices that the ignition key is in the keyhole. If the key is removed the key sensor 34 derives a L-voltage level signal to reset the RS-FF 36.

Under these conditions, when one of the push-button switches 10*a*–10*e* is depressed, binary coded signals are applied from the O-B convereter 11 to the second comparator 25. A code stored in the memory unit 14 is read out when the address counter 13 designates address No. 1. The second comparator 25 outputs a signal when the signals match to trigger the second monostable multivibrator 26. A locking signal is derived when the second RS-FF 27 is set. The transistors 32 and 33 are turned on in response to the locking signal, and current flows through the solenoid 29 in the direction of arrow B to lock the vehicle door.

In the door locking operation, although the first comparator 15 also derives a signal to advance the counter 16, since only one of the push-button switches 10*a*–10*e* has been depressed, the retriggerable multivibrator 22 is reset after a predetermined period of time and the counter 16 is reset, so that the unlocking command signal is not generated.

Now consider the operation of the power-operated car-radio antenna actuating section 5.

If the door is locked from outside the vehicle by depressing the appropriate push-button swithces 10*a*–10*e* with the antenna extending upwardly, the antenna switch 54 is set at the neutral position; the ignition switch 53 remains opened and the limit switch 56 is left closed (because the antenna has not yet telescoped completely), as shown in the Figure.

Under these conditions, when one of the push-button switches 10*a*–10*e* is depressed correctly, a locking command signal is derived from the second RS-FF 27 to turn on the transistors 32 and 33 so that current passes through the solenoid 29 in the direction of arrow B to lock the vehicle door.

Simultaneously, since the locking command signal is applied from the second RS-FF 27 to the third timer unit 50, the third timer unit 50 is activated in response to this locking command signal for a predetermined time period to supply a H-voltage level signal to the base of the transistor 51. As a result, the transistor 51 stays on for a predetermined time period to pass current through the relay coil 52*a*, so that the relay 52 is energized to close the relay contact 52*b*. Since the limit switch 56 is still closed, the supply voltage +Vc is applied to the second terminal of the antenna driving motor 55 via the relay 52 and the limit switch 56 in order to rotate the motor 55 in the direction to telescope the antenna. When the antenna is completely telescoped, since the limit switch 56 is open, the motor 55 stops rotating. Further, when the antenna has already been telescoped completely, since the limit switch 56 is left opened, the motor 55 does not rotate in either direction. In brief summary, even if the driver forgets that the power-operated car-radio antenna is left extended upwardly, since the antenna is automatically telescoped under the vehicle body whenever the vehicle doors are locked by depressing the push-button type switches, it is possible to park the vehicle safely and conveniently.

In the Figure, althrough only the embodiment of the power-operated car-radio antenna actuating device has been described, it is of course possible to actuate or drive other vehicle devices, for instance, to close the side door windows or sunroof, etc. by using the motor 55. Further, when a solenoid is provided as the actuator in place of the motor 55, it is possible to lock the trunk or the console box or to turn off the small lights (dimmed headlights) or an interior light. In such embodiments, since the third timer 50 output a H-voltage level signal only for a predetermined time period, a switch for opening the power line after the device has been actuated or turned off completely may be necessary in the same way as in the limit switch 56.

As described above, it is possible to safely park an automotive vehicles having an electronic door locking system according to the present invention wherein the vehicle doors are locked or unlocked when the driver depress a plurality of push-button type switches installed at an appropriate position on the outside of an automotive vehicle in accordance with a predetermined code, since the vehicle device is automatically returned to its original disabled condition in response to the locking command signal generated whenever the vehicle doors are locked, even if the driver carelessly forgets necessary actions for safely parking the vehicle.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. An electronic door locking system for an automotive vehicle for locking/unlocking vehicle doors, the vehicle being provided with vehicle devices, which comprises:

(a) a plurality of switches for outputting at least one predetermined door-locking octal coded digit and a sequence of predetermined door-unlocking octal coded digits;

(b) an octal-binary code converter connected to a plurality of said switches for converting the octal coded digits inputted from said switches into the corresponding binary coded digits;

(c) an address counter connected to said octal-binary code converter for counting up a plurality of the binary-coded signals outputted from said octal-binary code converter whenever one of said switches is depressed and outputting an address-designation signal in response to the number of signals outputted from said octal-binary code converter;

(d) a memory unit connected to said address counter for outputting a previously stored binary coded signal in response to the address-designation signal outputted from said address counter;

(e) a first comparator connected to said octal-binary code converter and said memory unit for outputtting a signal when one of the binary coded door-unlocking signals outputted from said octal-binary code converter agrees with one of the binary coded door-unlocking signals outputted from said memory unit in response to the respective address-designation signal outputted from said address counter;

(f) a counter connected to said first comparator for outputting a signal when said first comparator outputs the predetermined number of binary coded signals;

(g) a first reset-set flip-flop connected to said counter for outputting a door unlocking command signal when said first counter outputs the signal;

(h) a second comparator connected to said octal-binary code converter and said memory unit for outputting a signal when at least one binary coded door-locking signal outputted from said octal-binary code converter agrees with at least one binary coded door-locking signal outputted from said memory unit in response to the address-designation signal outputted from said address counter, (i) a second reset-set flip-flop connected to said second comparator for outputting a door locking command signal when said second counter outputs the signal; and (j) a door lock/unlock actuating solenoid connected to said first and second reset-set flip-flops for unlocking the vehicle doors when said first reset-set flip-flop is set and locking the vehicle doors when said second reset-set flip-flop is set; and (k) means for actuating at least one vehicle device to its original disabled condition in response to the lock command signal generated from said second reset-set flip-flop.

2. An electronic door locking system for an automotive vehicle for locking/unlocking vehicle doors as set forth in claim 1 wherein said means for actuating the at least one vehicle device to the original diabled condition thereof comprises:

(a) a timer unit for deriving a signal for a predetermined time period in response to the lock command signal from said second reset-set flip-flop;

(b) a switching element connected to said timer unit, said switching element being turned on in response to the signal from said timer unit;

(c) a relay connected to said switching element, said relay being energized when said switching element is turned on in response to the signal from said timer unit; and (d) an actuator for actuating the vehicle device to the original disabled condition thereof when said relay is energized.

3. An electronic door locking system for an automotive vehicle for locking/unlocking vehicle doors, the vehicle being provided with at least one vehicle device having an original normally disabled condition when the vehicle is not in use and susceptible to being activated to an enabled condition when the vehicle is in use, comprising:

(a) means located on the outside of the vehicle for deriving signals representing a sequence of unlocking coded numbers and at least one locking coded number;

(b) means for generating an unlock command signal in response to the signals representing the sequence of unlocking coded numbers derived from said signal deriving means;

(c) means for generating a lock command signal in response to a signal representing at least one locking coded number as derived from said means;

(d) means for unlocking the vehicle doors in response to the unlock command signal generated by said unlock command signal generating means and for locking the vehicle doors in response to the lock command signal generated by said lock comand signal generating means; and (e) means for actuating the vehicle device to the original disabled condition thereof in response to the lock command signal generated by said lock command signal generating means.

4. An electronic door locking system for an automotive vehicle for locking/unlocking vehicle doors as set forth in claim 3 wherein said means for actuating the at least one vehicle device to the original disabled condition thereof comprises:

(a) a timer unit for deriving a signal for a predetermined time period in response to the lock command signal from said lock command signal generating means;

(b) a switching element connected to said timer unit, said switching element being turned on in response to the signal from said timer unit;

(c) a relay connected to said switching element, said relay being energized when said switching element is turned on in response to the signal from said timer unit; and (d) an actuator for actuating the vehicle device to the original disabled condition thereof when said relay is energized.

5. An electronic door locking system for an automotive vehicle for locking/unlocking vehicle doors as set forth in claim 4, which further comprises a limit switch connected between said relay and said actuator for opening the power line connected to said actuator when said actuator returns the vehicle device to its original disabled condition completely.

* * * * *